US010233875B2

(12) United States Patent
Ojima et al.

(10) Patent No.: US 10,233,875 B2
(45) Date of Patent: Mar. 19, 2019

(54) SADDLE-RIDDEN VEHICLE

(71) Applicant: HONDA MOTOR CO., LTD., Tokyo (JP)

(72) Inventors: Naoki Ojima, Wako (JP); Teppei Hakamata, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/947,492

(22) Filed: Apr. 6, 2018

(65) Prior Publication Data

US 2018/0313304 A1 Nov. 1, 2018

(30) Foreign Application Priority Data

Apr. 28, 2017 (JP) ..... 2017-089286

(51) Int. Cl.
*F02M 35/02* (2006.01)
*F02M 35/16* (2006.01)

(52) U.S. Cl.
CPC ..... *F02M 35/0201* (2013.01); *F02M 35/162* (2013.01); *F01N 2590/04* (2013.01)

(58) Field of Classification Search
CPC ..... F02M 35/0201; F02M 35/162; F01N 2590/04
See application file for complete search history.

(56) References Cited

U.S. PATENT DOCUMENTS 4,402,379 A * 9/1983 Hoshi ..... B62K 11/00 180/225
4,509,613 A * 4/1985 Yamaguchi ..... B62J 35/00 180/219
6,283,242 B1 * 9/2001 Umeoka ..... B62K 11/04 180/219
6,287,354 B1 * 9/2001 Nozaki ..... B62D 61/02 180/219
6,840,206 B2 * 1/2005 Yasui ..... F02B 61/02 123/184.53

(Continued)

FOREIGN PATENT DOCUMENTS

JP 2639608 B2 8/1997
JP 2003-328722 A 11/2003

(Continued)

*Primary Examiner* — Jacob B Meyer
(74) *Attorney, Agent, or Firm* — Birch, Stewart, Kolasch & Birch, LLP

(57) ABSTRACT

A saddle-ridden vehicle includes: an engine and an air cleaner case that are supported to a body frame and respectively arranged in front and rear sides of the vehicle; a rear cushion arranged between the engine and the air cleaner case, the rear cushion being coupled to the body frame; and a connecting tube that extends forward from the air cleaner case and is coupled to the engine. The connecting tube upwardly bypasses an upper end of the rear cushion so as to be curvedly arranged under an occupant seat. The connecting tube defines a breather-gas return chamber between an inner wall and an upper-side outer wall of the connecting tube, the breather-gas return chamber being communicated with an internal space of the air cleaner case and receiving breather gas from the engine, the inner wall being integrated with the upper-side outer wall.

5 Claims, 6 Drawing Sheets

(56) References Cited

U.S. PATENT DOCUMENTS 6,868,843 B2 * 3/2005 Yasui ..... F02B 61/02 123/572
7,604,677 B2 * 10/2009 Tsuruta ..... B01D 46/0005 123/198 E
8,459,236 B2 * 6/2013 Ishii ..... B62M 7/02 123/468
8,776,924 B2 * 7/2014 Inoue ..... B62K 11/04 180/68.3
8,783,235 B2 * 7/2014 Shimizu ..... B62K 11/10 123/572
8,869,926 B2 * 10/2014 Higashiyama ..... B62J 37/00 180/219
8,944,197 B2 * 2/2015 Matsushima ..... B62J 1/12 180/68.3
9,140,222 B2 * 9/2015 Shimomura ..... F02M 35/162
9,181,908 B2 * 11/2015 Tani ..... F02M 35/162
9,211,930 B2 * 12/2015 Ishii ..... B62M 7/02
9,328,709 B2 * 5/2016 Higashiyama ..... F02M 69/00
9,845,784 B2 * 12/2017 Oto ..... F02M 35/044
2003/0226536 A1 * 12/2003 Yasui ..... F02B 61/02 123/184.53
2003/0226553 A1 * 12/2003 Yasui ..... F02B 61/02 123/573
2006/0064952 A1 * 3/2006 Oshima ..... B62K 5/01 55/385.3
2006/0272873 A1 * 12/2006 Isoda ..... B60K 13/02 180/68.3
2007/0045015 A1 * 3/2007 Yamamoto ..... B60R 16/04 180/68.5
2009/0242305 A1 * 10/2009 Asano ..... B62K 11/04 180/219
2013/0240277 A1 * 9/2013 Inoue ..... B62K 11/04 180/68.3
2014/0174394 A1 * 6/2014 Shimomura ..... F02M 35/162 123/184.21
2018/0313304 A1 * 11/2018 Ojima ..... F02M 35/0201

FOREIGN PATENT DOCUMENTS

JP 2004-11558 A 1/2004
JP 2006-97554 A 4/2006
JP 2007-62626 A 3/2007
JP 2013-194543 A 9/2013
JP 2014-122583 A 7/2014
JP 2015-42546 A 3/2015
JP 2016-43775 A 4/2016
WO WO 2011/118327 A1 9/2011

* cited by examiner

SADDLE-RIDDEN VEHICLE

BACKGROUND OF THE INVENTION

Field of the Invention

The present invention relates to a saddle-ridden vehicle comprising: an engine and an air cleaner case that are supported to a body frame and respectively arranged in front and rear sides of the vehicle; a rear cushion arranged between the engine and the air cleaner case and coupled to the body frame; and a connecting tube that extends forward from the air cleaner case and is coupled to the engine.

Description of the Related Art

Japanese Patent No. 2639608 discloses an intake device of a two-wheeled motor vehicle. The two-wheeled motor vehicle includes a rear cushion. The rear cushion is arranged between a body frame and a rear-wheel swing arm at the rear of an engine and a carburetor, and extends in an up-down direction. Below a seat rail and at the rear of the rear cushion, an air cleaner is arranged. The air cleaner is coupled to the carburetor ahead of the rear cushion with a connecting tube. In the air cleaner, a sub chamber that is coupled to a crankcase of the engine and receives breather gas (blow-by gas) of the engine is defined.

The connecting tube and the sub chamber for the breather gas are distributed to left and right of the rear cushion. The connecting tube curves to bypass the rear cushion in a vehicle width direction. When a sufficient volume is ensured at the connecting tube for forming a flow passage, the connecting tube bulges in the vehicle width direction.

SUMMARY OF THE INVENTION

The present invention has been achieved in view of the above-mentioned circumstances, and it is an object thereof to provide a saddle-ridden vehicle having an intake structure that ensures a sufficient volume of a connecting tube while avoiding a bulge in the vehicle width direction.

In order to achieve the object, according to a first feature of the present invention, there is provided a saddle-ridden vehicle comprising: an engine and an air cleaner case that are supported to a body frame and respectively arranged in front and rear sides of the vehicle; a rear cushion arranged between the engine and the air cleaner case, the rear cushion being coupled to the body frame; and a connecting tube that extends forward from the air cleaner case and is coupled to the engine, wherein the connecting tube upwardly bypasses an upper end of the rear cushion so as to be curvedly arranged under an occupant seat, and the connecting tube defines a breather-gas return chamber between an inner wall and an upper-side outer wall of the connecting tube, the breather-gas return chamber being communicated with an internal space of the air cleaner case and receiving breather gas from the engine, the inner wall being integrated with the upper-side outer wall.

With the first feature, the connecting tube bypasses above the rear cushion so as to be curvedly arranged under the occupant seat, thus ensuring a sufficient volume to the connecting tube. The breather-gas return chamber is integrated with the connecting tube. Thus, the breather-gas return chamber can be arranged nearer to an air passage communicated with an intake passage of the engine from the internal space of the air cleaner case inside the connecting tube. Thus, the breather gas (blow-by gas) can be efficiently returned to the engine. The blow-by gas containing evaporated fuel can flow in the connecting tube without passing through inside the air cleaner case. Thus, contamination of an air filter element inside the air cleaner case and the space inside the case can be suppressed. Moreover, the connecting tube includes the inner wall integrated with the outer wall so as to be reinforced based on the double walls. Thus, a strength of the connecting tube against an intake air vacuum of the engine can be enhanced.

According to a second feature of the present invention, in addition to the first feature, the connecting tube extends upward to a front from a front face of the air cleaner case at a position down from an upper end of the air cleaner case and defines a space between the connecting tube and the front face of the air cleaner case, the breather-gas return chamber being arranged in the space.

With the second feature, effectively using a dead space below the occupant seat, the breather-gas return chamber can be arranged.

According to a third feature of the present invention, in addition to the second feature, the body frame includes: left and right main frames extending downward to a rear from a head pipe; a cross member extending to left and right in a vehicle width direction so as to mutually couple the main frames; and left and right seat frames extending upward to the rear from the cross member so as to support the occupant seat, and the connecting tube passes through a space between the seat frames from the air cleaner case so as to extend forward through above the cross member.

With the third feature, the connecting tube can be protected from a collision factor from outside by the cross member and the left and right seat frames.

According to a fourth feature of the present invention, in addition to the third feature, the breather-gas return chamber is at least partially arranged inside the space between the seat frames and integrated with an upper side of the connecting tube.

With the fourth feature, the breather-gas return chamber is integrated with the upper side of the connecting tube. Thus, even if the connecting tube is arranged between the left and right seat frames, increase in a width of the occupant seat and an astride width can be avoided. Thus, a ride comfort of the saddle-ridden vehicle can be improved.

According to a fifth feature of the present invention, in addition to the fourth feature, there is provided the saddle-ridden vehicle, comprising: a battery case disposed so that the battery case and the air cleaner case are juxtaposed on left and right sides in the vehicle width direction; and a battery that is housed in the battery case and arranged along the connecting tube with a wall of the battery case interposed between the battery and the connecting tube.

With the fifth feature, the large box-shaped battery having a ready-made size is set along the side portion of the connecting tube ahead of the air cleaner case in the vehicle. Thus, while the size of the air cleaner case is increased to improve an engine performance, increase in size of the vehicle width can be avoided.

The above and other objects, characteristics and advantages of the present invention will be clear from detailed descriptions of the preferred embodiment which will be provided below while referring to the attached drawings.

DESCRIPTION OF THE PREFERRED EMBODIMENT

The following describes one embodiment of the present invention with reference to the attached drawings. Here, up and down, front and rear, and left and right of a vehicle body are directions when viewed by an occupant getting on a two-wheeled motor vehicle.

Figure 1:
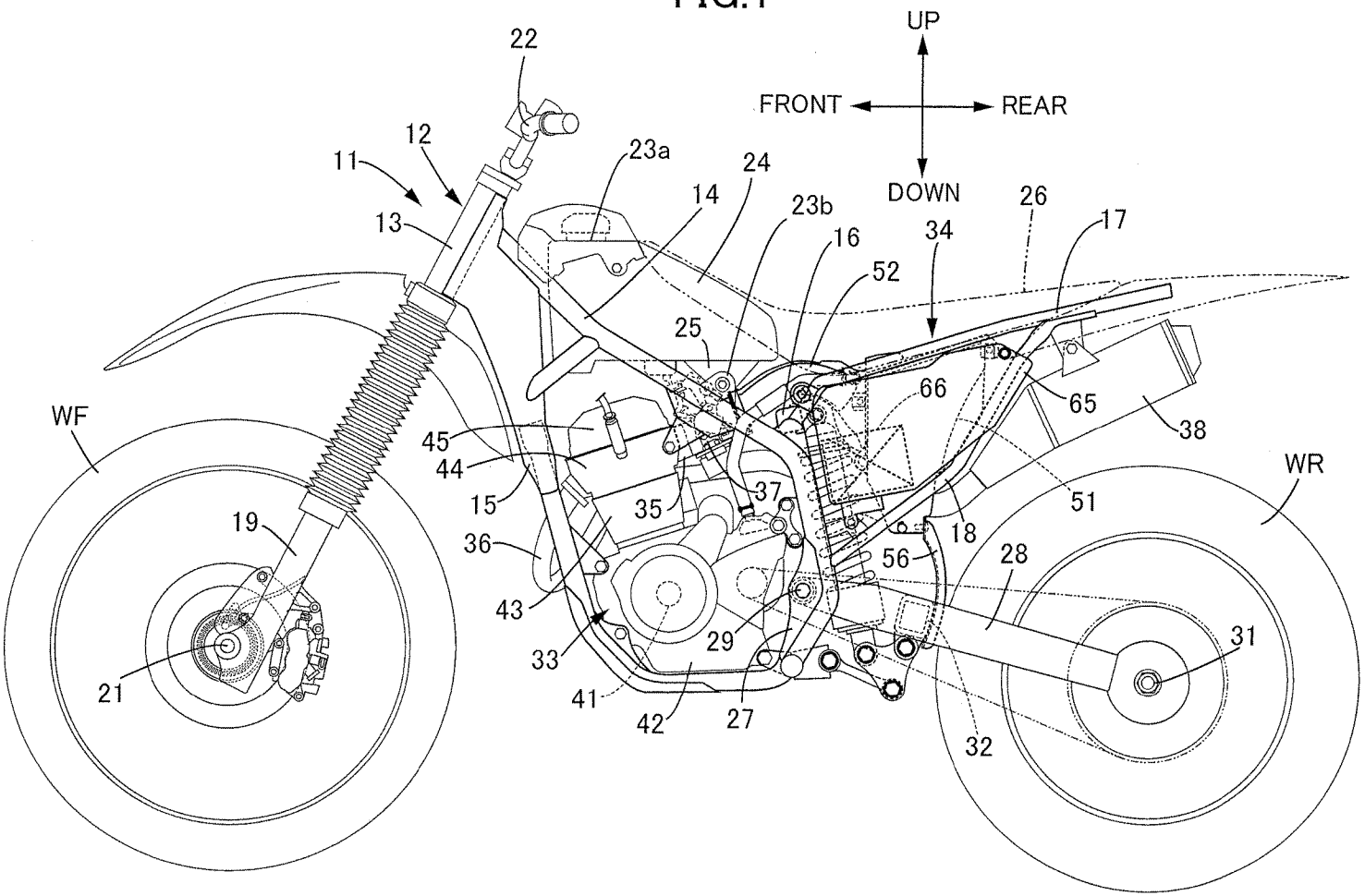
FIG. 1 is a side view schematically illustrating an overall configuration of a two-wheeled motor vehicle according to one embodiment of the present invention.

FIG. 1 schematically illustrates the two-wheeled motor vehicle as a saddle-ridden vehicle according to the one embodiment. A two-wheeled motor vehicle 11 includes a body frame 12. The body frame 12 includes a head pipe 13, a pair of left and right main frames 14, a pair of left and right down frames 15, a cross member 16, a pair of left and right seat frames 17, and a pair of left and right rear frames 18. The pair of left and right main frames 14 extend downward to the rear from the head pipe 13. The pair of left and right down frames 15 are arranged having an interval underneath the main frames 14, and extend downward from the head pipe 13 so as to be combined with the main frames 14 at lower ends. The cross member 16 horizontally extends to left and right in the vehicle width direction to couple the left and right main frames 14. The pair of left and right seat frames 17 extend upward to the rear from the cross member 16. The pair of left and right rear frames 18 are combined with the main frames 14 underneath the cross member 16 so as to extend upward to the rear to be combined with the seat frames 17 at rear ends. The rear frame 18 supports the seat frame 17 from the lower side.

To the head pipe 13, a front fork 19 is supported steerably around an axis. To the front fork 19, a front wheel WF is supported rotatably around an axle 21. The axle 21 has an axis thereof within an imaginary plane perpendicular to an extended line of the axis of the head pipe 13. The front fork 19 has an upper end with which a steering handlebar 22 is combined.

With the main frame 14, an upper bracket 23*a* and a lower bracket 23*b* are each combined, between the head pipe 13 and the cross member 16. To the upper bracket 23*a* and the lower bracket 23*b*, a fuel tank 24 is coupled. The upper bracket 23*a* at least partially covers an upper surface of the fuel tank 24. The lower bracket 23*b* supports the fuel tank 24 from the lower side. To the fuel tank 24, a fastening piece 25 is fixed. The fastening piece 25 extends downward from a lower surface of the fuel tank 24 so as to be fastened to the lower bracket 23*b*. The fastening piece 25 plays a role that ensures a space between the cross member 16 and the fuel tank 24.

On the seat frame 17, an occupant seat 26 is mounted. The occupant seat 26 has a front end that covers the fuel tank 24. As described above, since the fuel tank 24 is positioned above the cross member 16, a space is defined between the occupant seat 26 and the cross member 16, underneath the occupant seat 26.

The main frame 14 has a lower end to which a pivot bracket 27 is fixed. To the pivot bracket 27, a swing arm 28 is coupled swingably around a swing shaft 29. The swing arm 28 has a rear end to which a rear wheel WR is supported rotatably around an axle 31. The swing shaft 29 and the axle 31 extend in the vehicle width direction, in a horizontal direction parallel to the ground.

The swing arm 28 bifurcates into a right arm and a left arm rearward from the swing shaft 29 as seen in a plan view of the vehicle body so that rear ends of the swing arm 28 support, at both ends, the axle 31 of the rear wheel WR. The swing arm 28 has a coupling body 32 that extends in the vehicle width direction at a position rearward apart from the swing shaft 29 so as to mutually couple the right arm and the left arm. The coupling body 32 reinforces rigidity of the rear-fork-style swing arm 28.

To the body frame 12, an engine 33 and an air cleaner 34 arranged respectively in front and rear sides of the two-wheeled motor vehicle 11 are supported. The engine 33 is arranged between and fastened to the main frames 14 and the down frames 15. To the engine 33, an intake pipe 35 extending rearward from the engine 33 and an exhaust pipe 36 extending forward from the engine 33 are coupled. To the intake pipe 35, a throttle device 37 is coupled. On the throttle device 37, a fuel supply device is mounted. The throttle device 37 has an intake passage to which the air cleaner 34 is coupled. The exhaust pipe 36 is displaced off the rear wheel WR in the vehicle width direction as seen in a plan view of the vehicle body so as to be coupled to an exhaust muffler 38 arranged underneath the seat frame 17.

Figure 2:
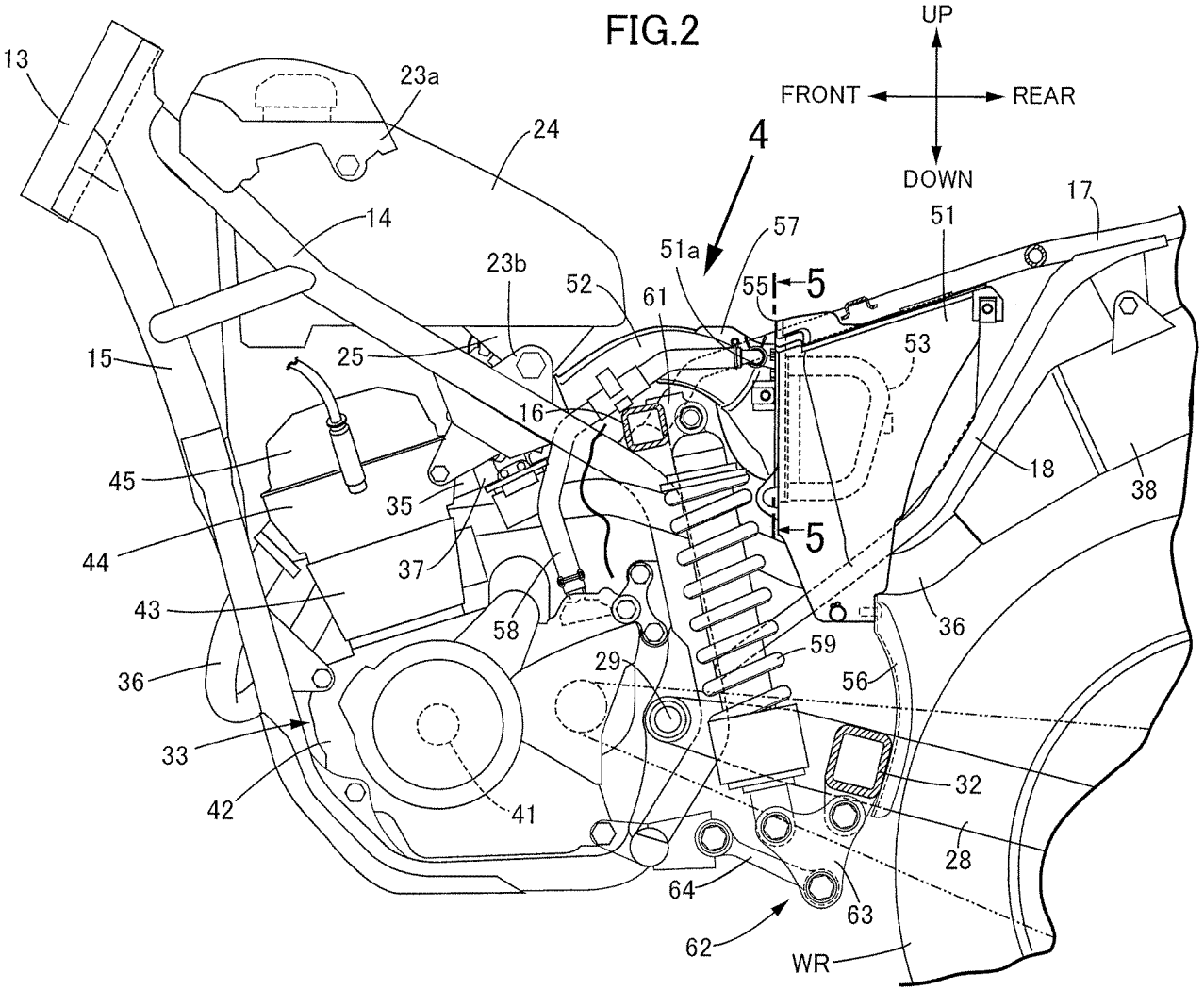
FIG. 2 is an enlarged side view of the two-wheeled motor vehicle partially cut out.

With reference to FIG. 2 together, the engine 33 includes a crankcase 42, a cylinder block 43, a cylinder head 44, and a head cover 45. The crankcase 42 houses, for example, a crankshaft 41 (and a transmission) so as to support the crankshaft 41 rotatably around a horizontal axis. The cylinder block 43 is combined with the crankcase 42 from above so as to define a cylinder that houses a single piston. The cylinder head 44 is combined with an upper end of the cylinder block 43 so as to define a combustion chamber between the cylinder head 44 and the piston. The head cover 45 is combined with the cylinder head 44 so as to cover a valve train supported to the cylinder head 44. The intake pipe 35 is combined with a rear face of the cylinder head 44. The exhaust pipe 36 is combined with a front face of the cylinder head 44.

Figure 3:
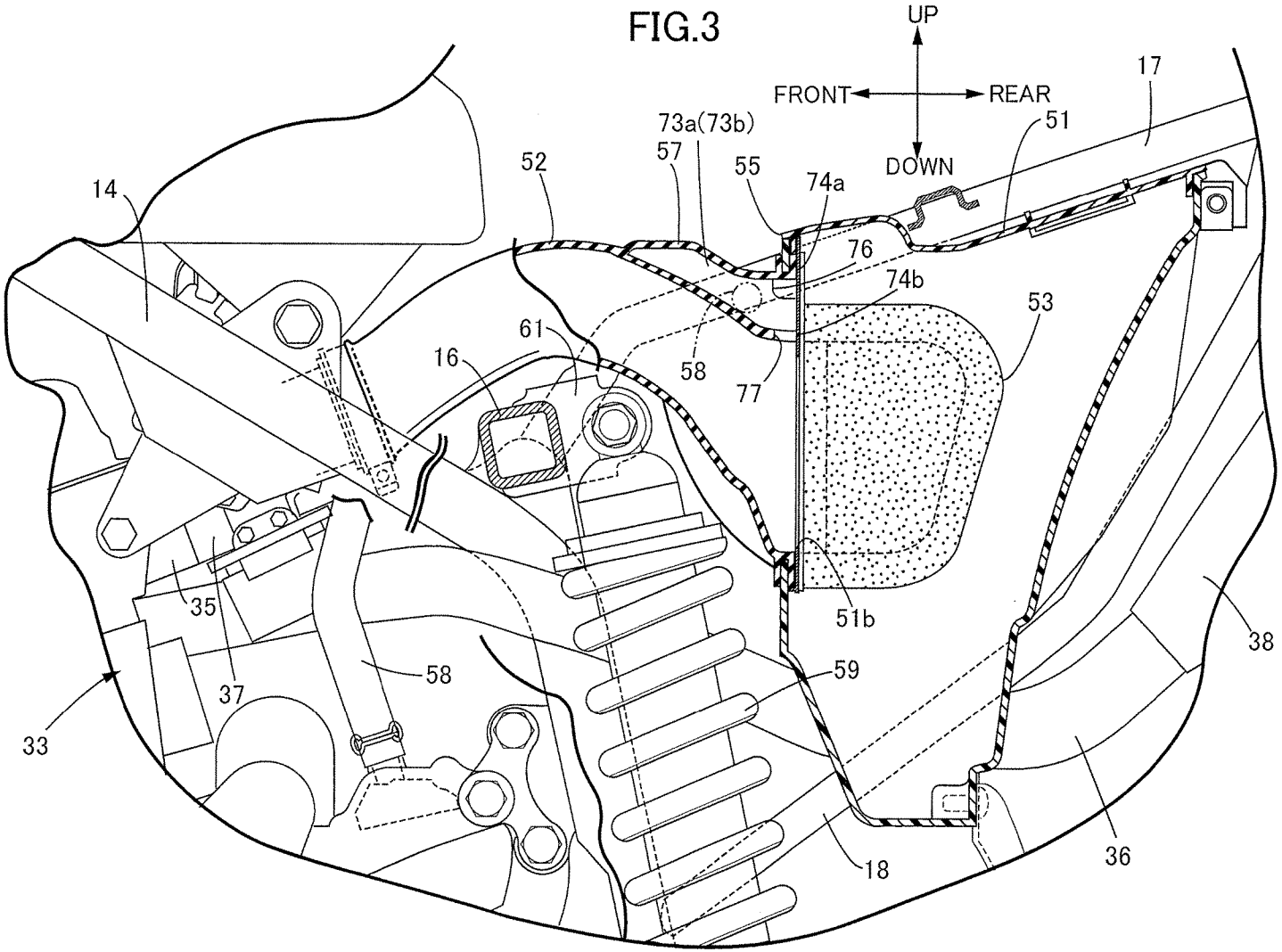
FIG. 3 is an enlarged vertical sectional view of an air cleaner case and a connecting tube.
Figure 4:
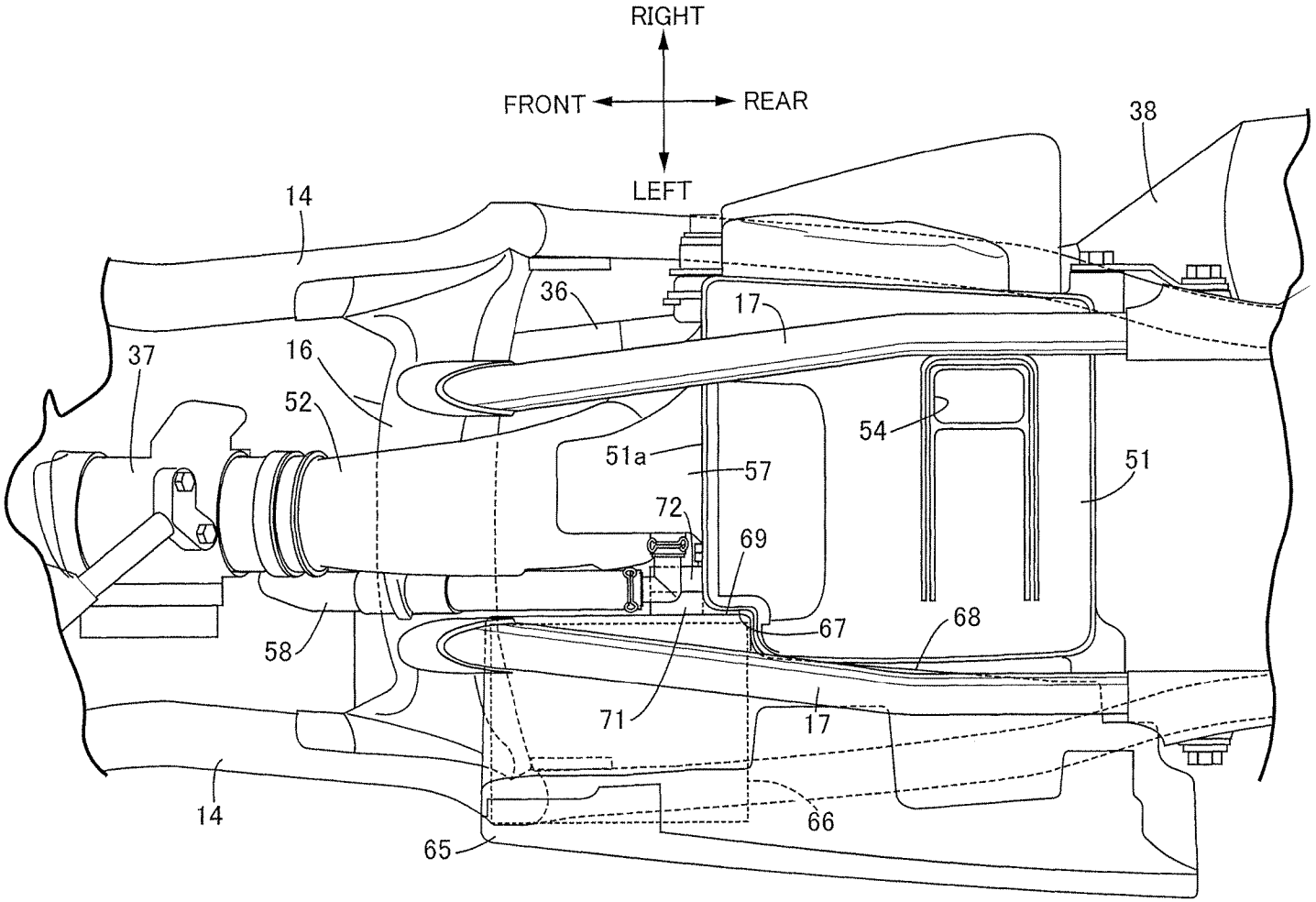
FIG. 4 is a view from an arrow 4 in FIG. 2.

The air cleaner 34 includes an air cleaner case 51 and a connecting tube 52. The air cleaner case 51 is suspended and supported by the seat frame 17 at the rear of the engine 33, and has a front wall 51*a* expanding along a vertical surface. The connecting tube 52 extends forward from the air cleaner case 51 under the occupant seat 26 so as to be coupled to the engine 33. As illustrated in FIG. 3, in the front wall 51*a* of the air cleaner case 51, an opening 51*b* is defined. The opening 51*b* is covered with a filter element 53 from an inside of the air cleaner case 51. Air inside the air cleaner case 51 is filtered with the filter element 53 so as to flow in the opening 51*b*. As illustrated in FIG. 4, in an upper surface of the air cleaner case 51, an inflow port 54 is defined. External air flows in an internal space of the air cleaner case 51 from the inflow port 54.

As illustrated in FIG. 3, the connecting tube 52 is disposed so as to extend upward to the front from a front face of the air cleaner case 51 at a position down from an upper end 55 of the air cleaner case 51, and pass through above the cross member 16, and then be curved downward. The connecting tube 52 passes through a space ensured between the cross member 16 and the fuel tank 24. As illustrated in FIG. 4, the connecting tube 52 passes through a space between the left and right seat frames 17. The connecting tube 52 has a front end combined with the intake passage of the throttle device 37. The connecting tube 52 has an intratubular space coupled to the internal space of the air cleaner case 51 through the opening 51*b* of the front wall 51*a*. The air filtered with the filter element 53 is supplied from the connecting tube 52 to the engine 33 through the intake passage of the throttle device 37.

The air cleaner case 51 is formed long in an up-down direction with respect to its lateral width, while setting the connecting tube 52 at a center position in the vehicle width direction. The air cleaner case 51 extends downward through a side portion of the exhaust pipe 36 coupled to the exhaust muffler 38. As illustrated in FIG. 4, the exhaust pipe 36 is arranged displaced to the right side with respect to a center surface in the vehicle width direction. Thus, the air cleaner case 51 is arranged at a center in the vehicle width direction so as to face the rear wheel WR. As illustrated in FIG. 2, to the air cleaner case 51, a mud guard 56 is fixed. The mud guard 56 extends downward from a lower end of the air cleaner case 51 so as to face the rear wheel WR.

As illustrated in FIG. 3, being adjacent to the front face of the air cleaner case 51, a bulge portion 57 is formed on an upper surface of the connecting tube 52. The bulge portion 57 is at least partially arranged in the space between the left and right seat frames 17. The connecting tube 52 extends upward to the front from the front face of the air cleaner case 51 at the position down from the upper end 55 of the air cleaner case 51. Thus, between the front face of the air cleaner case 51 and the connecting tube 52, a space where the bulge portion 57 is arranged is defined. Thus, the bulge portion 57 is arranged at a position lower than a horizontal surface including the upper end 55 of the air cleaner case 51.

With the bulge portion 57, one end of a breather pipe 58 is combined. The breather pipe 58 has another end combined with an upper surface of the crankcase 42. The breather pipe 58 couples a space (a breather-gas return chamber described later) inside the bulge portion 57 to a space inside the crankcase 42. A joint of the breather pipe 58 to the bulge portion 57 is arranged inside the space between the left and right seat frames 17.

As illustrated in FIG. 2, between the engine 33 and the air cleaner case 51, to the body frame 12, a rear cushion 59 is coupled. The rear cushion 59 passes through between the right arm and left arm of the swing arm 28 between the swing shaft 29 of the swing arm 28 and the coupling body 32. The rear cushion 59 has an upper end coupled to a bracket 61 rotatably around the horizontal axis. The bracket 61 protrudes rearward from the cross member 16. The rear cushion 59 has a lower end coupled to the coupling body 32 of the swing arm 28 via a link mechanism 62. The link mechanism 62 includes a link plate 63 that specifies a rotation axis around the horizontal axis at three apexes of a triangle. To the link plate 63, the lower end of the rear cushion 59 is coupled rotatably around the first rotation axis, the coupling body 32 of the swing arm 28 is coupled rotatably around the second rotation axis, and a link bar 64 is coupled rotatably around the third rotation axis. The link bar 64 has another end coupled to the lower end of the main frame 14 rotatably around the horizontal axis. With such action of the link mechanism 62, the lower end of the rear cushion 59 can be arranged at a position lower than the swing arm 28. As a result, the upper end of the rear cushion 59 can be arranged downward apart from the occupant seat 26 while ensuring sufficient stroke at the rear cushion 59. The rear cushion 59 absorbs vibration that acts on the rear wheel WR from the road surface. The connecting tube 52 upwardly bypasses the upper end of the rear cushion 59. The mud guard 56 is arranged between the rear wheel WR and the rear cushion 59.

As illustrated in FIG. 1, a battery case 65 is supported between the seat frame 17 and the rear frame 18 as seen in the left side view. In the battery case 65, a battery 66 and other electric components are housed. As illustrated in FIG. 4, the battery case 65 is disposed so that the battery case 65 and the air cleaner case 51 are juxtaposed on left and right sides in the vehicle width direction.

On the air cleaner case 51, a step 67 depressed from the side face is formed. Also on the battery case 65, correspondingly, a step 68 depressed from the side face is formed. The step 68 forms a bulge 69 on the side face of the battery case 65. The bulge 69 of the battery case 65 fits into the step 67 of the air cleaner case 51. The bulge 69 of the battery case 65 reflects a shape of the battery 66. Thus, the battery 66 is arranged along the connecting tube 52 with a wall of the battery case 65 interposed between the battery 66 and the connecting tube 52.

The battery case 65 includes a boss 71 projecting from the bulge 69 toward the air cleaner case 51. On the front wall 51*a* of the air cleaner case 51, a coupling piece 72 is integrally formed. The coupling piece 72 projects from the front face of the air cleaner case 51 so as to overlap the boss 71. The coupling piece 72 is fastened to the boss 71. The battery case 65 and the air cleaner case 51 are mutually combined.

Figure 5:
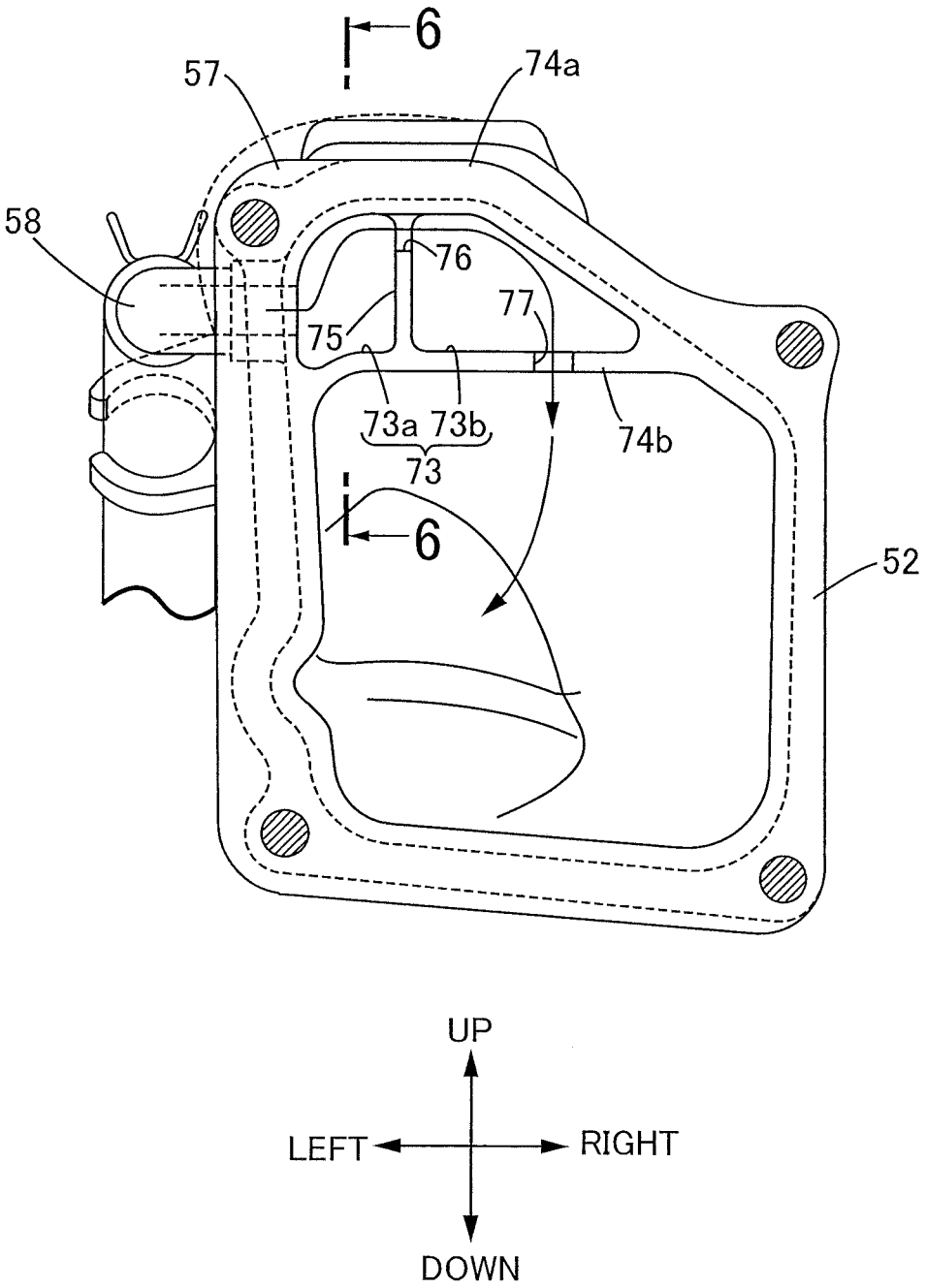
FIG. 5 is an enlarged sectional view along a line 5-5 in FIG. 2.
Figure 6:
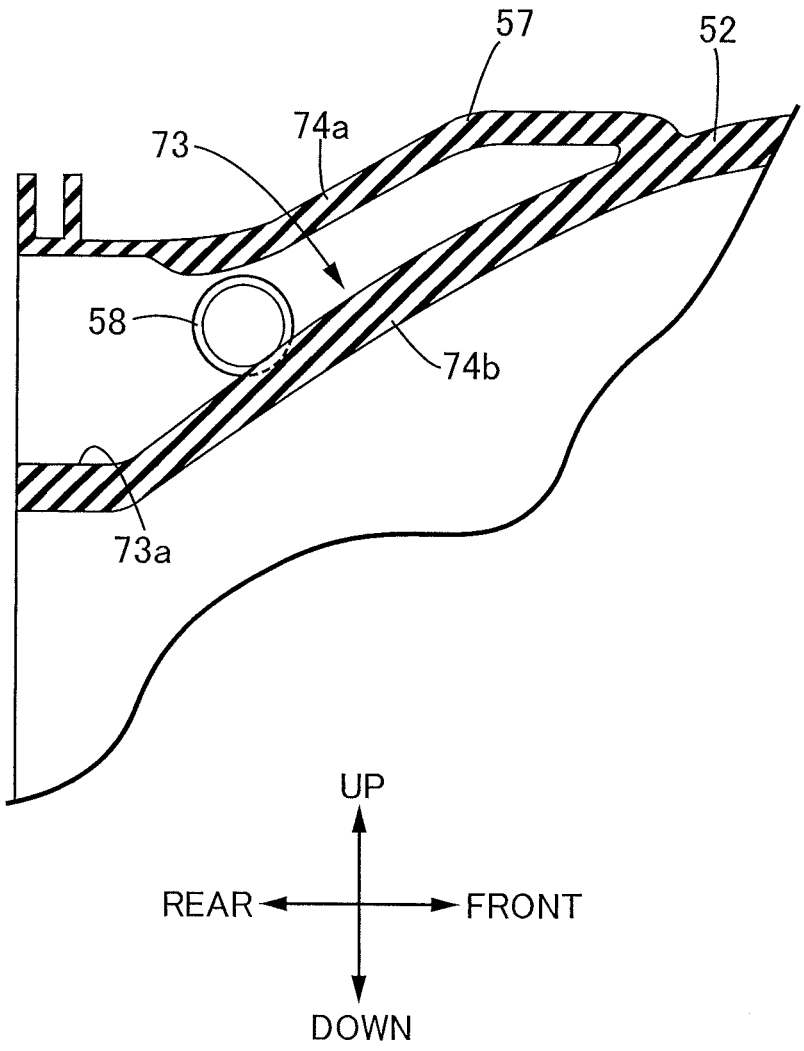
FIG. 6 is an enlarged sectional view along a line 6-6 in FIG. 5.

As illustrated in FIG. 5 and FIG. 6, the connecting tube 52 defines a breather-gas return chamber 73 that receives the breather gas (blow-by gas) from the engine 33, inside the bulge portion 57. The breather-gas return chamber 73 is defined between an outer wall 74*a* and an inner wall 74*b* of the bulge portion 57. The inner wall 74*b* is integrally formed with the outer wall 74*a* and positioned below the outer wall 74*a*. Thus, the breather-gas return chamber 73 is integrated with the upper side of the connecting tube 52.

The breather-gas return chamber 73 includes a first chamber 73*a* and a second chamber 73*b*. The breather pipe 58 opens to the first chamber 73*a*. The second chamber 73*b* is separated from the first chamber 73*a* with a vertical wall 75 so as to be coupled to the first chamber 73*a* at an opening 76 at an upper end of the vertical wall 75. The second chamber 73*b* is coupled to the intratubular space inside the connecting tube 52 through an opening 77 defined in the inner wall 74*b* that is a bottom surface. The breather-gas return chamber 73 is communicated with the internal space of the air cleaner case 51.

The following describes an operation of the embodiment. The air cleaner 34 includes the air cleaner case 51 supported to the body frame 12 so as to be arranged at the rear of the engine 33, and the connecting tube 52 extending forward from the air cleaner case 51 so as to be coupled to the engine 33. The connecting tube 52 is disposed so as to upwardly bypass the upper end of the rear cushion 59 and be curved, under the occupant seat 26. As a result, even if the sufficient volume is ensured for the connecting tube 52, the bulge in the vehicle width direction is avoided.

In this embodiment, since the breather-gas return chamber 73 is integrated with the connecting tube 52, the breather-gas return chamber 73 is arranged nearer to the air passage communicated with the intake passage of the throttle device 37 from the internal space of the air cleaner case 51, inside the connecting tube 52. The breather gas (blow-by gas) can be efficiently returned to the engine 33. Since the blow-by gas containing the evaporated fuel can flow in the connecting tube 52 without passing through inside the air cleaner case 51, contamination of the filter element 53 inside the air cleaner case 51 and the space inside the case is suppressed. Moreover, since the connecting tube 52 includes the inner wall 74*b* integrated with the outer wall 74*a* so as to be reinforced based on the double walls, the strength of the connecting tube 52 against the intake air vacuum of the engine 33 is enhanced.

The joint of the breather pipe 58 to the bulge portion 57 is arranged inside the space between the left and right seat frames 17. The joint is protected from a collision factor from outside.

The connecting tube 52 extends upward to the front from the front face of the air cleaner case 51 at the position down from the upper end of the air cleaner case 51, so as to define the space, where the breather-gas return chamber 73 is arranged, between the connecting tube 52 and the front face of the air cleaner case 51. Effectively using a dead space below the occupant seat 26, the breather-gas return chamber 73 can be arranged.

The connecting tube 52 extends through above the cross member 16 through the space between the seat frames 17. The connecting tube 52 is protected from the collision factor from outside by the cross member 16 and the left and right seat frames 17.

Since the breather-gas return chamber 73 is integrated with the upper side of the connecting tube 52, even if the connecting tube 52 is arranged between the left and right seat frames 17, increase in width of the occupant seat 26 and the astride width is avoided. Thus, the ride comfort of the two-wheeled motor vehicle 11 can be improved.

The battery 66 is housed in the battery case 65 so as to be arranged along the connecting tube 52 with the wall of the battery case 65 interposed between the battery 66 and the connecting tube 52. Along the side portion of the connecting tube 52 ahead of the air cleaner case 51 in the vehicle, the large box-shaped battery 66 having the ready-made size is set. Thus, the increase in size of the vehicle width can be avoided while increasing the size of the air cleaner case 51 to improve the engine performance. The battery case 65 is formed in the structure that fits into the step 67 of the air cleaner case 51. Thus, the battery case 65 and the air cleaner case 51 are mutually reinforced to be an integral strength member, thus achieving a thin-wall weight reduction compared with one where the battery case 65 and the air cleaner case 51 are individually disposed alone.

The air cleaner case 51 extends downward through the side portion of the exhaust pipe 36 coupled to the exhaust muffler 38 from the engine 33. The mud guard 56 is fixed to the air cleaner case 51, the mud guard 56 extending downward from the lower end of the air cleaner case 51 so as to be arranged between the rear wheel WR and the rear cushion 59. The air cleaner case 51 and the mud guard 56 effectively prevent mud spatter from the rear wheel WR to the rear cushion 59. The air cleaner case 51 is formed long in the up-down direction with respect to the lateral width, while setting the connecting tube 52 at the center position in the vehicle width direction, so as to ensure the sufficient volume. Thus, the air cleaner case 51 extends downward with respect to the rear frame 18. Since the air cleaner case 51 partially has the function of the mud guard 56, the mud guard 56 can be shortened in the up-down direction.

What is claimed is:

1. A saddle-ridden vehicle comprising:

an engine and an air cleaner case that are supported to a body frame and respectively arranged in front and rear sides of the vehicle;

a rear cushion arranged between the engine and the air cleaner case, the rear cushion being coupled to the body frame; and a connecting tube that extends forward from the air cleaner case and is coupled to the engine, wherein the connecting tube upwardly bypasses an upper end of the rear cushion so as to be curvedly arranged under an occupant seat, and the connecting tube defines a breather-gas return chamber between an inner wall and an upper-side outer wall of the connecting tube, the breather-gas return chamber being communicated with an internal space of the air cleaner case and receiving breather gas from the engine, the inner wall being integrated with the upper-side outer wall.

2. The saddle-ridden vehicle according to claim 1, wherein the connecting tube extends upward to a front from a front face of the air cleaner case at a position down from an upper end of the air cleaner case and defines a space between the connecting tube and the front face of the air cleaner case, the breather-gas return chamber being arranged in the space.

3. The saddle-ridden vehicle according to claim 2, wherein the body frame includes:

left and right main frames extending downward to a rear from a head pipe;

a cross member extending to left and right in a vehicle width direction so as to mutually couple the main frames; and left and right seat frames extending upward to the rear from the cross member so as to support the occupant seat, and the connecting tube passes through a space between the seat frames from the air cleaner case so as to extend forward through above the cross member.

4. The saddle-ridden vehicle according to claim 3, wherein the breather-gas return chamber is at least partially arranged inside the space between the seat frames and integrated with an upper side of the connecting tube.

5. The saddle-ridden vehicle according to claim 4, comprising:

a battery case disposed so that the battery case and the air cleaner case are juxtaposed on left and right sides in the vehicle width direction; and a battery that is housed in the battery case and arranged along the connecting tube with a wall of the battery case interposed between the battery and the connecting tube.

* * * * *